US008109071B2

(12) United States Patent
Gilmore

(10) Patent No.: US 8,109,071 B2
(45) Date of Patent: Feb. 7, 2012

(54) LINE STRUCTURE FOR MARINE USE IN CONTAMINATED ENVIRONMENTS

(75) Inventor: Justin Gilmore, Lafayette, LA (US)

(73) Assignee: Samson Rope Technologies, Ferndale, WA (US)

( * ) Notice: Subject to any disclaimer, the term of this patent is extended or adjusted under 35 U.S.C. 154(b) by 239 days.

(21) Appl. No.: 12/466,237

(22) Filed: May 14, 2009

(65) Prior Publication Data

US 2009/0282801 A1 Nov. 19, 2009

Related U.S. Application Data

(60) Provisional application No. 61/127,881, filed on May 16, 2008.

(51) Int. Cl.
*D02G 3/02* (2006.01)
*D02G 3/22* (2006.01)

(52) U.S. Cl. ..... 57/211

(58) Field of Classification Search ..... 57/210–235
See application file for complete search history.

(56) References Cited

U.S. PATENT DOCUMENTS

| | | | | |
|---|---|---|---|---|
| 3,367,095 | A | 2/1968 | Field, Jr. | |
| 3,977,172 | A | 8/1976 | Kerawalla | |
| 4,155,394 | A | 5/1979 | Shepherd et al. | |
| 4,170,921 | A | 10/1979 | Repass | |
| 4,534,163 | A * | 8/1985 | Schuerch | 57/233 |
| 4,947,917 | A | 8/1990 | Noma et al. | |
| 5,240,769 | A | 8/1993 | Ueda et al. | |
| 5,327,714 | A * | 7/1994 | Stevens et al. | 57/230 |
| 5,802,839 | A | 9/1998 | Van Hook | |
| 5,822,791 | A | 10/1998 | Baris | |
| 6,341,550 | B1 | 1/2002 | White | |
| 6,876,798 | B2 | 4/2005 | Triplett et al. | |
| 6,945,153 | B2 | 9/2005 | Knudsen et al. | |
| 7,093,416 | B2 * | 8/2006 | Johnson et al. | 57/212 |
| 7,127,878 | B1 | 10/2006 | Wilke et al. | |
| 7,134,267 | B1 | 11/2006 | Gilmore et al. | |
| 7,165,485 | B2 | 1/2007 | Smeets et al. | |
| 7,168,231 | B1 | 1/2007 | Chou et al. | |
| 7,367,176 | B1 | 5/2008 | Gilmore et al. | |
| 7,389,973 | B1 | 6/2008 | Chou et al. | |
| 7,437,869 | B1 | 10/2008 | Chou et al. | |
| 7,735,308 | B1 | 6/2010 | Gilmore et al. | |

(Continued)

FOREIGN PATENT DOCUMENTS

WO 03102295 A1 12/2003

OTHER PUBLICATIONS

Herzog Braiding Machines, "Rope Braiding Machines Seng 140 Series," date unknown, 2 pages.*

(Continued)

*Primary Examiner* — Shaun R Hurley
(74) *Attorney, Agent, or Firm* — Michael R. Schacht; Schacht Law Office, Inc.

(57) ABSTRACT

The present invention may be embodied as a line structure for use as a mud line assembly. In this case, the line structure comprises a plurality of strands, and each of the strands comprises a core portion, a jacket portion, and a barrier portion. The barrier portion is arranged between the core portion and the jacket portion to inhibit movement of contaminate material into the core portion.

19 Claims, 2 Drawing Sheets

U.S. PATENT DOCUMENTS

| | | | | |
|---|---|---|---|---|
| 7,739,863 | B1 | 6/2010 | Chou et al. | |
| 7,743,596 | B1 | 6/2010 | Chou et al. | |
| 7,908,955 | B1 | 3/2011 | Chou et al. | |
| 2003/0226347 | A1 | 12/2003 | Smith et al. | |
| 2004/0069132 | A1 | 4/2004 | Knudsen et al. | |
| 2005/0036750 | A1 | 2/2005 | Triplett et al. | |
| 2005/0172605 | A1* | 8/2005 | Vancompernolle et al. | 57/237 |
| 2005/0279074 | A1* | 12/2005 | Johnson et al. | 57/212 |
| 2006/0048497 | A1* | 3/2006 | Bloch | 57/230 |
| 2007/0079695 | A1 | 4/2007 | Bucher et al. | |

OTHER PUBLICATIONS

Herzog Braiding Machines, "Rope Braiding Machiens Seng 160 Series," date unknown, 2 pages.*

Samson Rope Technologies, Inc., "Samson Offshore Expansion Celebrated," Feb. 18, 2009, 2 pages.

Samson Rope Technologies, Inc., "Samson Deep Six Performs Beyond Expectation," Sep. 10, 2008, 2 pages.

USPTO, Office Action U.S. Appl. No. 12/243,079, Jun. 28, 2010, 8 pages.

SLO, Response U.S. Appl. No. 12/243,079, Oct. 28, 2010, 13 pages.

USPTO, Notice of Allowance, U.S. Appl. No. 12/243,079, Nov. 8, 2010, 16 pages.

SLO, Amendment After NOA, U.S. Appl. No. 12/243,079, Jan. 3, 2011, 4 pages.

USPTO, Issue Notification, U.S. Appl. No. 12/243,079, Mar. 2, 2011, 1 page.

USPTO, Office Action U.S. Appl. No. 12/815,363, Feb. 22, 2011, 10 pages.

SLO, Response U.S. Appl. No. 12/815,363, May 23, 2011, 9 pages.

USPTO, Final Office Action U.S. Appl. No. 12/815,363, Aug. 15, 2011, 6 pages.

U.S. District Court, *Samson Rope Technologies, Inc.* v. *Yale Cordage, Inc.* Case 2:11-cv-00328, Document 1, Complaint (2), DI 001-2011-02-24, 5 pages.

U.S. District Court, *Samson Rope Technologies, Inc.* v. *Yale Cordage, Inc.* Case 2:11-cv-00328-JLR, Document 5, Notice to PTO, DI 005-2011-02-25, 1 page.

U.S. District Court, *Samson Rope Technologies, Inc.* v. *Yale Cordage, Inc.* Case 2:11-cv-00328-JLR, Document 12, Answer, DI 012-2011-05-10, 6 pages.

USPTO, Office Action U.S. Appl. No. 12/463,284, Apr. 8, 2011, 13 pages.

SLO, Response U.S. Appl. No. 12/463,284, Jul. 8, 2011, 12 pages.

* cited by examiner

LINE STRUCTURE FOR MARINE USE IN CONTAMINATED ENVIRONMENTS

RELATED APPLICATIONS

This application claims priority of U.S. Provisional Patent Application Ser. No. 61/127,881 filed May 16, 2008, the contents of which are incorporated herein by reference.

TECHNICAL FIELD

The present invention relates to lines for use in marine environments and, more particularly, to lines designed for use in applications where at least a portion of the line is in a contaminated environment such as on or below the surface of the sea floor.

BACKGROUND

The term "mud line" is conventionally used in the petroleum industry to refer to the boundary between earth and water. An anchor assembly used as part of an offshore anchoring system is typically submerged in the silt and mud defining the mud line at the bottom of the body of water. Conventional anchor assemblies typically employ chains, wires, or cables made of metal. The need exists for improved anchor assemblies and line structures for use as part of anchor assemblies.

SUMMARY

The present invention may be embodied as a line assembly comprising a line structure comprising a plurality of strands, where each of the strands comprises a core portion, a jacket portion, and a barrier portion. The barrier portion is arranged between the core portion and the jacket portion to inhibit movement of contaminate material into the core portion.

The present invention may also be embodied as a line structure for use as a mud line assembly. In this case, the line structure comprises a plurality of strands, and each of the strands comprises a core portion, a jacket portion, and a barrier portion. The barrier portion is arranged between the core portion and the jacket portion to inhibit movement of contaminate material into the core portion.

The present invention may also be embodied as a line assembly comprising a line structure comprising a plurality of strands, where each of the strands comprises a core portion, a jacket portion, and a barrier portion comprising filter material. The filter material is arranged around the core portion to inhibit movement of contaminate material into the core portion.

DETAILED DESCRIPTION

Figure 1:
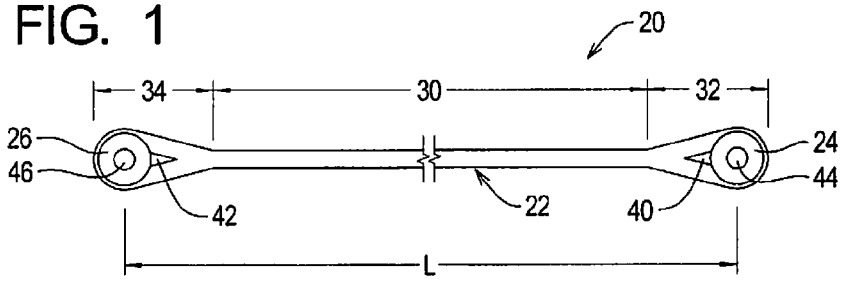
FIG. 1 is a perspective view of a first example line assembly constructed in accordance with, and embodying, the principles of the present invention.

Referring initially to FIG. 1 of the drawing, depicted therein is a first example line assembly 20 of the present invention comprising a line member 22 and optional first and second thimbles 24 and 26. The line member 22 defines an intermediate portion 30 and first and second end portions 32 and 34. The first and second end portions 32 and 34 define first and second end openings 40 and 42, respectively. The end portions 32 and 34 are or may be formed by conventional techniques for terminating line structures.

If used, the thimbles 24 and 26 are arranged within the end openings 40 and 42, respectively, in a conventional manner. The thimbles 24 and 26 are or may be conventional and define generally circular thimble openings 44 and 46, respectively. The thimbles 24 and 26 are designed to protect the line member 22 while transferring to the line member 22 loads from other components (not shown) of the anchoring system in which the line assembly 20 is used.

The first example line assembly 20 defines a length L between the centers of the thimble openings 44 and 46. The length L of the example line assembly 20 is approximately 335 feet; however the length of any line assembly constructed in accordance with the principles of the present invention will be determined based on the particular operating conditions under which the line assembly is to be used.

Figure 2:
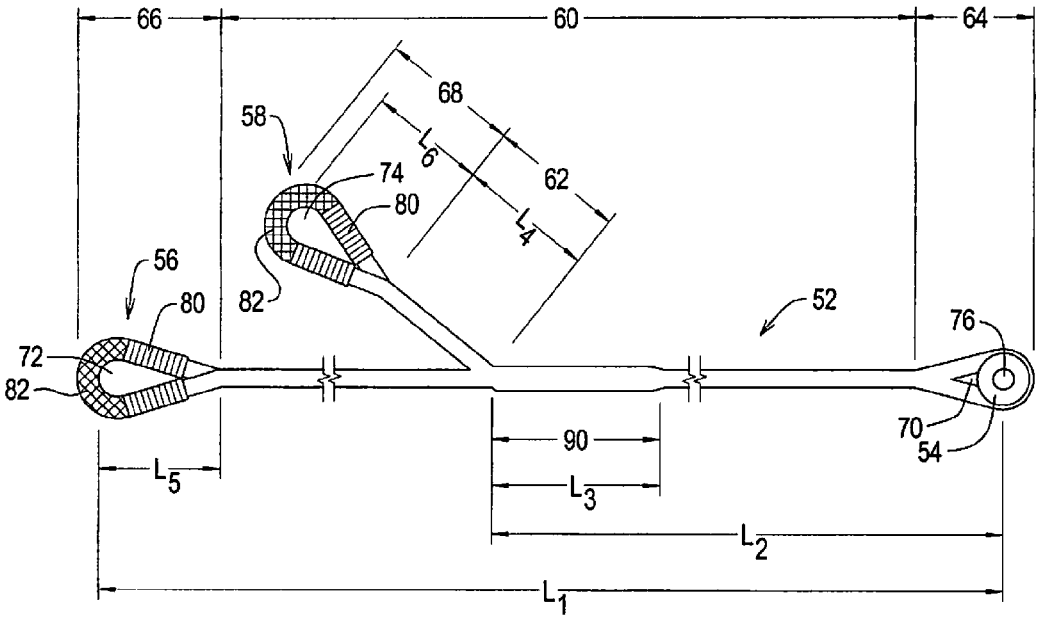
FIG. 2 is a perspective view of a second example line assembly constructed in accordance with, and embodying, the principles of the present invention.

Turning now to FIG. 2 of the drawing, depicted therein is a second example line assembly 50 comprises a line member 52, an optional thimble 54, and optional first and second protection assemblies 56 and 58. The line member 52 defines an intermediate portion 60, a deployment portion 62, and first, second and third end portions 64, 66, and 68. The first, second, and third end portions 64, 66, and 68 define first, second, and third end openings 70, 72, and 74, respectively. The end portions 64, 66, and 68 are or may be formed by conventional techniques for terminating line structures.

The thimble 54 is arranged within the first end opening 70 in a conventional manner. The thimble 54 is or may be conventional and defines a generally circular thimble opening 76. The thimble opening 76 is designed to transfer to the line member 52 loads from other components (not shown) of the anchoring system in which the line assembly 50 is used.

The protection structures 56 and 58 are arranged to cover portions of the second and third end portions 66 and 68 of the line member 52 defining the second and third end openings 72 and 74, respectively. The example protection structures 56 and 58 each comprise a whipping structure 80 and a chafe structure 82. The whipping structure 80 is first wrapped around portions of the second and third end portions 66 and 68 of the line member 52. The chafe structure 82 is then wrapped around at least a portion of the whipping structure 80. The protection structures 56 and 58 are or may be formed in a conventional manner and are designed to protect the line member 52 when the line assembly 50 is connected to other components (not shown) of the anchoring system in which the line assembly 50 is used.

The second example line assembly 50 defines a primary length $L_1$ between the center of the thimble opening 76 and the inside surface of the second end portion 66 defining the second end opening 72. The second example line assembly 50 further defines a secondary length $L_2$ between the center of the thimble opening 76 and the point at which the deployment portion 62 extends from the intermediate portion 60. The example deployment portion 62 is spliced into the intermediate portion 60 over a splice area 90 having a splice length $L_3$. The deployment portion 62 defines a deployment length $L_4$. The second and third end portions 66 and 68 define first and second end lengths $L_5$ and $L_6$, respectively.

In the example line assembly 50, the primary length $L_1$ is approximately 105 feet, the secondary length $L_2$ is approximately 37 feet, the splice length $L_3$ is approximately 12 feet, the deployment length $L_4$ is approximately 10 feet, and the first and second end lengths $L_5$ and $L_6$, are approximately 8 feet. Again, the lengths of any line assembly constructed in accordance with the principles of the present invention will be determined based on the particular operating conditions under which the line assembly is to be used.

The line members 22 and 52 may differ in construction, composition, geometry, and dimensions, but share certain characteristics that render these members 22 and 52 appropriate for use as part of the line assemblies 20 and 50 described above. In addition, the characteristics shared by the line members 22 and 52 may be configured for use as part of any line system or assembly that will be subjected to operating conditions similar to those encountered by the example line assemblies 20 and 50 described herein. In the following discussion, an example line structure that may be used to form the line members 22 and 52 will be described in further detail.

Figure 3:
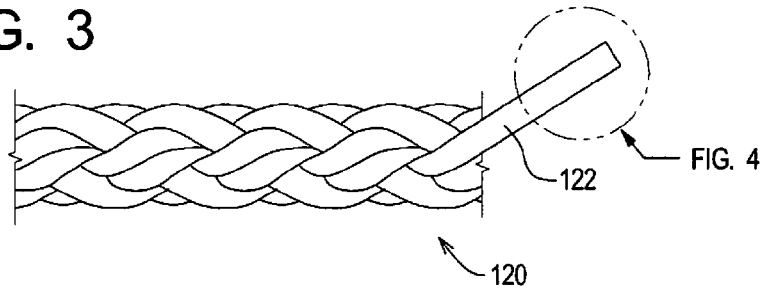
FIG. 3 is a view of a section of the first and second example line assemblies depicted in FIGS. 1 and 2.
Figure 4:
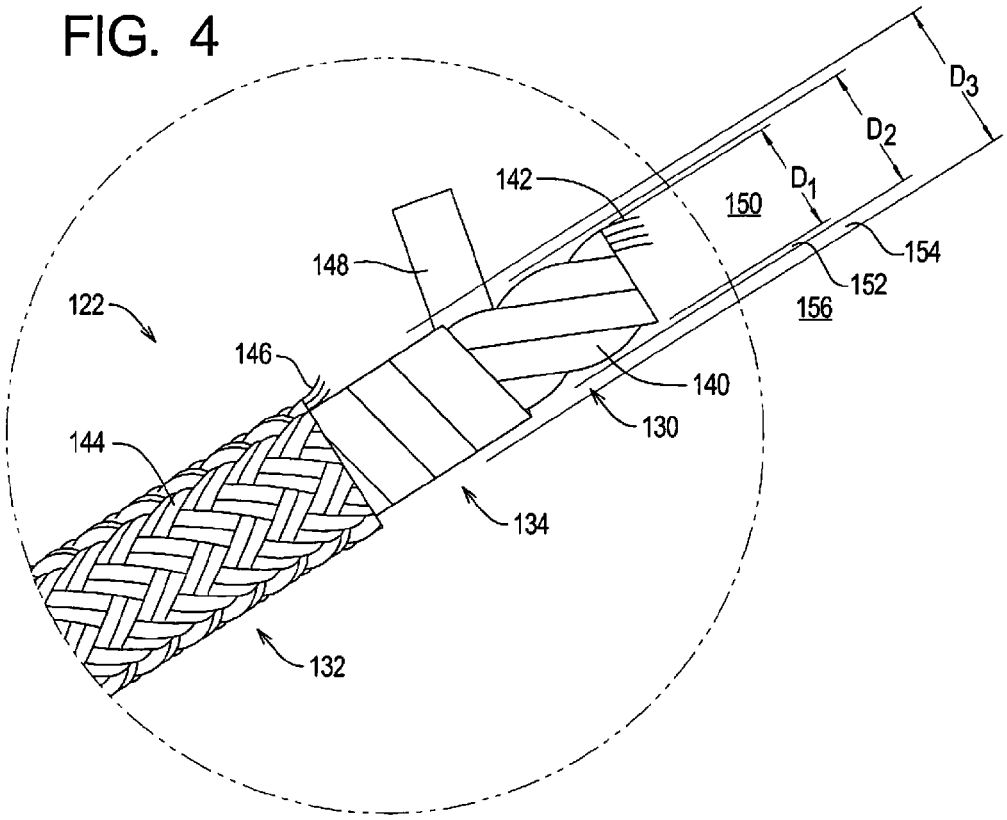
FIG. 4 is a view of a section of an example strand that may be used as part of the first and second example line assemblies depicted in FIGS. 1 and 2.

Referring now to FIGS. 3 and 4 of the drawing, depicted therein is an example line structure 120 that may be used to form the example line members 22 and 52 or any other line member designed for use under similar operating conditions. The example line structure 120 comprises a plurality of strands 122 as shown in FIG. 3. The strands 122 are combined in any conventional manner to obtain a line structure 120 that meets the load conditions of the intended use environment.

The strands 122 in turn comprise a core portion 130, a jacket portion 132, and a barrier portion 134. The core portion 130 comprises a plurality of core yarns 140 comprising core fibers 142, while the jacket portion 132 comprises a plurality of jacket yarns 144 comprising a plurality of jacket fibers 146. The core yarns 140 and jacket yarns 144 in turn may comprise a plurality of components such as smaller yarns or bundles of fibers. The barrier portion 134 comprises at least one strip of barrier material 148 that is arranged between the core portion 130 and the jacket portion 132.

The example strands 122 thus define an interior region 150 that is substantially but not completely occupied by the core fibers 142 forming the core portion 130. In cross-section, the interior region 150 is substantially in the shape of a circle having a core diameter $D_1$. The example strands 122 further define a barrier region 152 that is substantially occupied by the barrier material 148. In cross-section, the barrier region is substantially annular, with an inner diameter of equal to the core diameter $D_1$ and an outer diameter equal to a barrier diameter $D_2$. The example strands 122 further define a jacket region 154 that is substantially occupied by the jacket fibers 146 defining the jacket portion 132. In cross-section, the jacket region 154 is substantially annular, with an inner diameter of equal to the barrier diameter $D_2$ and an outer diameter equal to a jacket diameter $D_3$. The jacket diameter $D_3$ defines the nominal diameter of the example strands 122. An exterior region 156 is defined as anything outside of the outer boundaries of the barrier region 152.

The barrier material 148 is arranged to inhibit movement of contaminate material from the exterior region 156 to the interior region 150. Contaminate material is any foreign matter not present in the line structure 120 when originally manufactured. In general, contaminate material enters line structures over time. When mixed in with the fibers forming a line structure, contaminate material can be detrimental to the operation and/or wear life of the line structure.

In the context of a line structure intended for use as an anchor assembly or under similar conditions, the line structure is often submerged under pressure in a liquid bath of fine particles suspended within water. The applicant has determined that, under pressure and movement of the line structure, the suspended particles easily flow within the rope structure. The Applicant has further determined that problems associated with the intrusion of contaminate material are exacerbated in the context of a line structure designed for use as part of an anchor assembly or the like because contaminate material between and around the fibers forming the line structure degrades the line structure and can cause failure thereof.

In the context of the example line structure 120, the core portion 130 forms the prime load bearing element of the line structure 120. The barrier material 148 is arranged to inhibit contamination of the core portion 130 by contaminate material, even though the entire line structure 120 may be submerged within a fluid bath comprising particulates. The barrier material 148 thus improves abrasion resistance of the overall line structure 120. The operation and/or wear life of the core fibers 142 is thus less likely to be adversely affected by contaminate material.

The example barrier material 148 is designed to prevent egression of particulate material down to 2 microns in size (i.e., greater than approximately 2 microns). The exact specifications of the barrier material 148 can be selected based on the particular environment in which the line structure 120 is to be used.

The example barrier material 148 is a strip of filter tape that is wrapped in a helical configuration around the core portion 130 with edges of the filter tape overlapping as perhaps best shown at 160 in FIG. 4. Accordingly, when wrapped around the entire core portion 130, the filter tape forming the barrier material 148 forms a continuous barrier in the barrier region 152 that inhibits the egression of particulate from the exterior region 156 to the interior region 150.

The filter tape forming the barrier material 148 may comprise adhesive material on one side such that the barrier material 148 adheres to itself and to the core portion 130. If used, the adhesive material helps the barrier material to stay in place around the core portion 130.

In the example line structure 120, the jacket portion 132 is formed by a tight cover braid of urethane coated jacket fibers 146. The jacket portion 132 surrounds the barrier material 148, protecting the barrier material 148 and holding the barrier material 148 in place around the core portion 130. The jacket portion 132 further provides stiffness to the line structure 120. Providing stiffness to the line structure 120 aids with ROV connections commonly used when installing, servicing, and removing offshore anchoring systems.

The example strands 122 employ an 8×3 construction. Although other constructions may be possible, the 8×3 construction provides the advantages of both laid and braided ropes.

The core fibers 142 and the jacket fibers 146 of the example line structure 120 employs are formed by high molecular polyethylene (HMPE). HMPE fibers provide good strength and abrasion resistance. HMPE also provides a low specific gravity, meaning that the line structure 120 will float in water. Using a line structure 120 capable of floating in water yields a line member that simplifies the connection of mooring lines and anchor retrieval. Other fibers such as LCPs are also candidates for use in line structures configured for use as anchor line assemblies and the like.

The present invention is of particular significance when used as part of the Delmar Systems Inc. Omni-Max anchoring system, and the two example line assemblies 22 and 52 disclosed herein are configured for use as part of the Omni-Max anchoring system. However, the concepts of the present invention may be applied to any line member intended for use under similar operating conditions.

What is claimed is:

1. A line assembly adapted for underwater use at the boundary between earth and water, comprising:

a line structure comprising a plurality of strands, where each of the strands comprises a core portion comprising a plurality of core yarns, where each of the core yarns comprises a plurality of core fibers, a jacket portion comprising a plurality of jacket yarns, where each of the jacket yarns comprises a plurality of jacket fibers, and a barrier portion provided for each strand; wherein the barrier portion is arranged between the core portion and the jacket portion of each strand to inhibit movement of contaminate material into the core portions of the strands.

2. A line assembly as recited in claim 1, in which the barrier portion comprises filter material arranged around each core portion.

3. A line assembly as recited in claim 1, in which the barrier portion comprises at least one strip of filter material arranged around each core portion.

4. A line assembly as recited in claim 1, in which the barrier portion comprises at least one strip of filter tape arranged around each core portion.

5. A line assembly as recited in claim 4, in which the filter tape defines at least one adhesive surface adapted to secure the filter tape to each core portion.

6. A line assembly as recited in claim 4, in which the filter tape is wrapped around each core portion in a helical configuration.

7. A line assembly as recited in claim 6, in which edges of the filter tape overlap.

8. A line assembly as recited in claim 1, in which the barrier portion inhibits movement of particulate material larger than approximately 2 microns.

9. A line structure for use as a mud line assembly, where the line structure comprises:

a plurality of strands, where each of the strands comprises a core portion comprising a plurality of core yarns, where each of the core yarns comprises a plurality of core fibers, a jacket portion comprising a plurality of jacket yarns, where each of the jacket yarns comprises a plurality of jacket fibers, and a barrier portion provided for each strand; wherein the barrier portion is arranged between the core portion and the jacket portion of each strand to inhibit movement of contaminate material into the core portions of the strands.

10. A line assembly as recited in claim 9, in which the barrier portion comprises filter material arranged around each core portion.

11. A line assembly as recited in claim 9, in which the barrier portion comprises at least one strip of filter material arranged around each core portion.

12. A line assembly as recited in claim 9, in which the barrier portion comprises at least one strip of filter tape arranged around each core portion.

13. A line assembly as recited in claim 12, in which the filter tape defines at least one adhesive surface adapted to secure the filter tape to each core portion.

14. A line assembly as recited in claim 12, in which the filter tape is wrapped around each core portion in a helical configuration.

15. A line assembly as recited in claim 12, in which edges of the filter tape overlap.

16. A line assembly as recited in claim 9, in which the barrier portion inhibits movement of particulate material larger than approximately 2 microns.

17. A line assembly adapted for underwater use in silt and mud at the boundary between earth and water, comprising:

a line structure comprising a plurality of strands, where each of the strands comprises a core portion comprising a plurality of core yarns, where each of the core yarns comprises a plurality of core fibers, a jacket portion comprising a plurality of jacket yarns, where each of the jacket yarns comprises a plurality of jacket fibers, and a barrier portion provided for each strand, where the barrier portion comprises filter material; wherein the filter material is arranged around the core portion of each strand to inhibit movement of contaminate material into the core portions of the strands.

18. A line assembly as recited in claim 17, in which the filter material comprises at least one strip of filter tape defining at least one adhesive surface, where the filter tape is wrapped around the core portion in a helical configuration such that edges of the filter tape overlap.

19. A line assembly as recited in claim 17, in which the filter material inhibits movement of particulate material larger than approximately 2 microns.

* * * * *